United States Patent [19]

Unger

[11] Patent Number: 4,602,532

[45] Date of Patent: Jul. 29, 1986

[54] APPARATUS FOR APPLYING AND RELEASING WOOD SCREWS, PROVIDED WITH SUSPENSION HOOKS, AND ALSO MAGNETIC HOLDERS, TO AND FROM COMPARATIVELY HIGH STRUCTURAL PARTS

[76] Inventor: Henry M. Unger, 24 Sunset Dr., Weston, Conn. 06880

[21] Appl. No.: 640,495

[22] Filed: Aug. 13, 1984

[30] Foreign Application Priority Data

Sep. 3, 1983 [DE] Fed. Rep. of Germany ..... 3331885
May 17, 1984 [DE] Fed. Rep. of Germany ..... 3418342

[51] Int. Cl.[4] ..... B25B 13/02

[52] U.S. Cl. ..... 81/119; 81/177.8; 81/901

[58] Field of Search ..... 81/119, 125, 176.15, 81/124.2, 177.1, 177.2, 177.6, 177.7, 177.8, 488, 900, 901, 125.1; 7/138; 403/109

[56] References Cited

U.S. PATENT DOCUMENTS

| | | | |
|---|---|---|---|
| D. 60,270 | 1/1922 | Shedd | 81/125.1 |
| 363,331 | 5/1887 | Hammer | 7/138 |
| 882,937 | 3/1908 | Fegley | 81/901 |
| 1,034,383 | 7/1912 | Bronson | 81/177.5 |
| 1,188,305 | 6/1916 | Noerteman | 81/125 |
| 1,474,404 | 11/1923 | Church | 81/119 |
| 1,512,559 | 10/1924 | Moore | 81/119 |
| 1,558,267 | 10/1925 | McGuckin | 81/125 |
| 1,641,252 | 9/1927 | Dickey | 81/125 |
| 1,810,006 | 6/1931 | Edwards | 81/177.6 |
| 1,835,315 | 12/1931 | McLay | 81/177.6 |
| 2,097,361 | 10/1937 | Bagley | 81/177.6 |
| 2,231,323 | 2/1941 | Cawood | 81/452 |
| 4,247,216 | 1/1981 | Pansini | 403/109 |

FOREIGN PATENT DOCUMENTS 23482 of 1892 United Kingdom .

*Primary Examiner*—Frederick R. Schmidt
*Assistant Examiner*—Bradley I. Vaught
*Attorney, Agent, or Firm*—John C. Smith, Jr.

[57] ABSTRACT

To enable wood screws provided with a suspension hook having a shank, and also magnetic holders having a shank, to be applied to and released from comparatively high structural parts by an operator standing on the floor or ground below, an apparatus is provided which comprises a carrier arm including two legs by means of one of which it is affixed in a direct or indirect manner to one end of a hollow cylindrical body enabling the apparatus to be inserted, for example, into a handle bar which can be extended and retracted telescopically and to be secured therein, the other leg of the carrier arm having a bifurcated portion provided for the reception therein of the shank of a wood screw or magnetic holder and fixing it in the proper position for applying or releasing the wood screw or magnetic holder.

14 Claims, 8 Drawing Figures

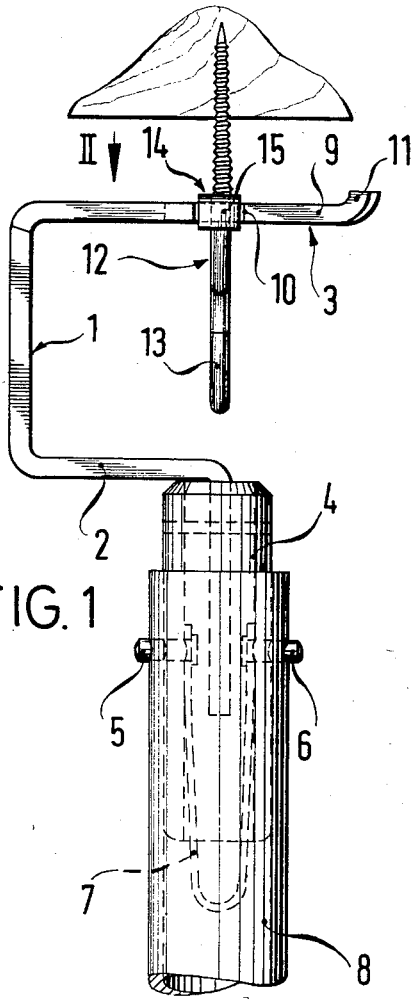
FIG. 1
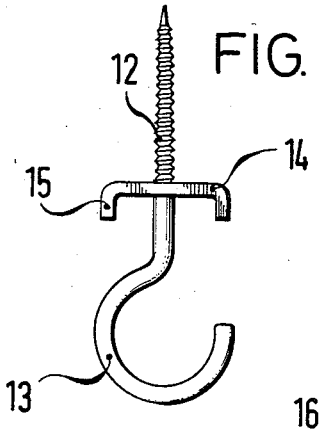
FIG. 3
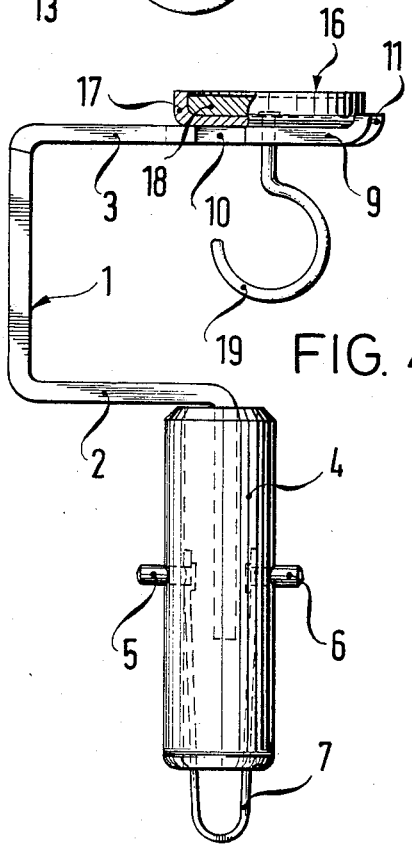
FIG. 4
FIG. 2
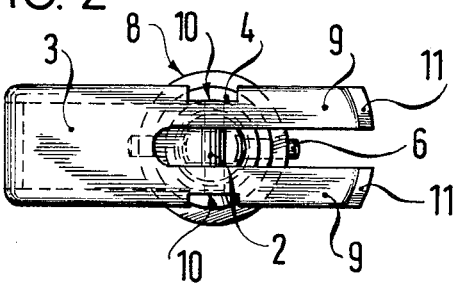

APPARATUS FOR APPLYING AND RELEASING WOOD SCREWS, PROVIDED WITH SUSPENSION HOOKS, AND ALSO MAGNETIC HOLDERS, TO AND FROM COMPARATIVELY HIGH STRUCTURAL PARTS

BACKGROUND OF THE INVENTION

This invention relates to an apparatus for applying and releasing wood screws, provided with suspension hooks, and also magnetic holders, to and from comparatively high stuctural parts.

For affixing and releasing screws or magnetic holders of this kind situated comparatively high above floor level it has hitherto been necessary to use a ladder or a makeshift support. The operation of placing a ladder or other stand in position, however, is not only complicated and time-consuming but often actually impossible, or at all events difficult, owing to the particular conditions prevailing on the spot.

SUMMARY OF THE INVENTION

It is the object of the present invention to avoid these disadvantages and to provide an apparatus by means of which a wood screw having a suspension hook and placed the apparatus can easily and reliably be screwed in and unscrewed at a considerable height from the floor, and a magnetic holder of the kind customarily available on the market can likewise by applied and released by a person standing on the floor without recourse to a ladder or other means of ascent.

To attain this object the present invention provides an apparatus for applying and releasing wood screws, provided with suspension hooks, and also magnetic holders, to and from comparatively high structural parts, comprising a carrier arm including two legs; a hollow cylindrical body connected to one of said legs, the other leg of the carrier arm having a bifurcated portion for the reception therein of one end of the shank of a wood screw or of the shank of a magnetic holder, each of said shanks merging at its other end into a suspension hook; means for connecting said hollow cylindrical body to said one leg, and means for detachably securing a handle bar to said hollow cylindrical body.

The apparatus is connectible by the connecting means to a telescopic handle bar, such as is generally used, after the insertion of a tool, for cleaning window panes and the like at a considerable height above ground level, the apparatus being either inserted in or mounted on the handle bar by the hollow cylindrical body, in each case in such a way that it will not rotate in relation to the latter. To attain this end, the connecting means may comprise a solid connecting portion formed in a forward portion of the hollow cylindrical body and adapted for rigid connection to said one leg via a bent end part of said one leg.

The carrier arm may be of rectangular cross section and substantially C-shaped so as to comprise two spaced legs and a web portion therebetween.

For the purpose of inserting or unscrewing a wood screw with the aid of the apparatus, the bifurcated portion of the said other leg of the carrier arm has preferably two opposite external edge cutouts. These external edge cutouts are intended to be engaged by rearwardly bent ends of a transversal arm which is rigidly secured to the shank of the wood screw, in which process the shank of the wood screw is accommodated by the bifurcated portion. By suitably tating the apparatus by means of the handle bar the wood screw is then screwed in or unscrewed, after which the apparatus is removed from the bent ends of the transversal arm of the wood screw.

For the application or release of a magnetic holder provided with a suspension hook and of the kind consisting of a dish with a magnet rigidly affixed in the dish and in use, for example, for suspending placards, advertising signs, prices and the like in department stores, the apparatus is mounted by the bifurcated portion of the carrier arm onto the shank of the suspension hook of the magnetic holder. The magnet of the magnetic holder is then pressed with the aid of the apparatus against a structural part of iron to which it is to be applied or else detached from the said structural part by lifting up one side of the apparatus, after which the latter can be removed from the shank of the suspension hook.

In an advantageous further development of the invention the carrier arm is of inverted L-shape comprising two legs and the means for connecting the hollow cylindrical body to said one leg comprise a bent part formed at the free end of the one leg facing towards the hollow cylindrical body, a holder consisting of flat material and firmly inserted by one of its ends in the hollow cylindrical body and provided at its other end with a bent part, a bearing eye for a joint bolt provided at one end of each of the bent parts, said joint bolt having a widened head at one of its ends and an external screw thread at the other end projecting beyond the bearing eyes, and a screw nut screwed upon the external screw thread and tightenable against the bearing eyes.

The use of the apparatus for applying a wood screw, for example, to a structural part presents no difficulty if the operator is able to apply the screw vertically from where he is standing. If, however, the wood screw is to be applied to a structural part at a point which makes it impossible for the operator to take up a position enabling the apparatus to be applied in the vertical direction, the wood screw cannot be applied at all as long as the carrier arm is rigidly connected to the hollow cylindrical body of the apparatus. The same applies to the task of applying a magnetic holder to a structural part of iron. An example of circumstances making it impossible for the operator to change his position would be a case in which the apparatus had to be held by its handle bar over a counter in a department store in order to apply the apparatus to a structural part at the point at which a wood screw or magnetic holder is to be placed in position. Owing to the articulated connection of the carrier arm of the apparatus to the hollow cylindrical body the carrier arm in each case can be adjusted to such an angle in relation to the handle bar that even if the handle bar is held on the slant the wood screw can be applied vertically to the structural part on which it is required, or the magnetic holder can be pressed in a horizontal position against the structural part of iron, as the case may be.

In an advantageous further development of the invention the said one leg of the carrier arm of the apparatus which is provided with the bent part is provided on its outside with two clamps fixed in position side by side and at a certain distance apart and serving to secure the wood screw on the said one leg of the carrier arm, at least part of the threaded shank portion of the wood screw extending beyond the front end of the said one leg, and the bent part has a projection situated opposite the one leg of the carrier arm, the wood screw being additionally held in its position between said projection and the said one leg by means of its suspension hook, by which it rests against the bent part.

This arrangement of the wood screw is an improvement on that adopted hitherto in that the shank of the wood screw no longer requires an arm positioned transversally and rigidly in relation thereto and having rearwardly bent ends in order to secure the wood screw against rotation in the bifurcated portion of the one leg of the carrier arm. The wood screw can thus be produced more cheaply than before. After the wood screw has been screwed into the structural part the apparatus can be detached by pulling it.

In a further advantageous embodiment of the invention the bifurcated portion of the carrier arm of the apparatus has upwardly bent free ends.

The magnetic holder accommodated by the bifurcated portion of the carrier arm of the apparatus is thus prevented from accidentally falling out of the said bifurcated portion of the carrier arm when being applied or released, as it is unable to move beyond the upwardly bent free ends of the bifurcated portion.

In a further advantageous embodiment of the invention two spring-loaded bolts, situated opposite each other, are displaceably mounted, in a manner known per se, in borings in the wall of the hollow cylindrical body of the apparatus. When the apparatus is inserted into a telescopic handle bar the spring-loaded bolts engage borings in the wall of the handle bar, thus preventing axial and radial displacement of the apparatus relative to the telescopic handle bar.

BRIEF DESCRIPTION OF THE DRAWINGS

Two embodiments of the invention will now be described by way of example and with reference to the accompanying drawings in which:

FIG. 1 is a side elevational view of one embodiment of the apparatus according to the invention, connected to a telescopic handle bar and applied to a wood screw provided with a suspension hook;

FIG. 2 is a plan view, seen in the direction of the arrow II in FIG. 1, of the apparatus without a wood screw;

FIG. 3 is a side elevational view of the wood screw;

FIG. 4 is a side elevational view of the apparatus without a handle bar, applied to a magnetic holder provided with a suspension hook;

DESCRIPTION OF THE PREFERRED EMBODIMENTS

Figure 5:
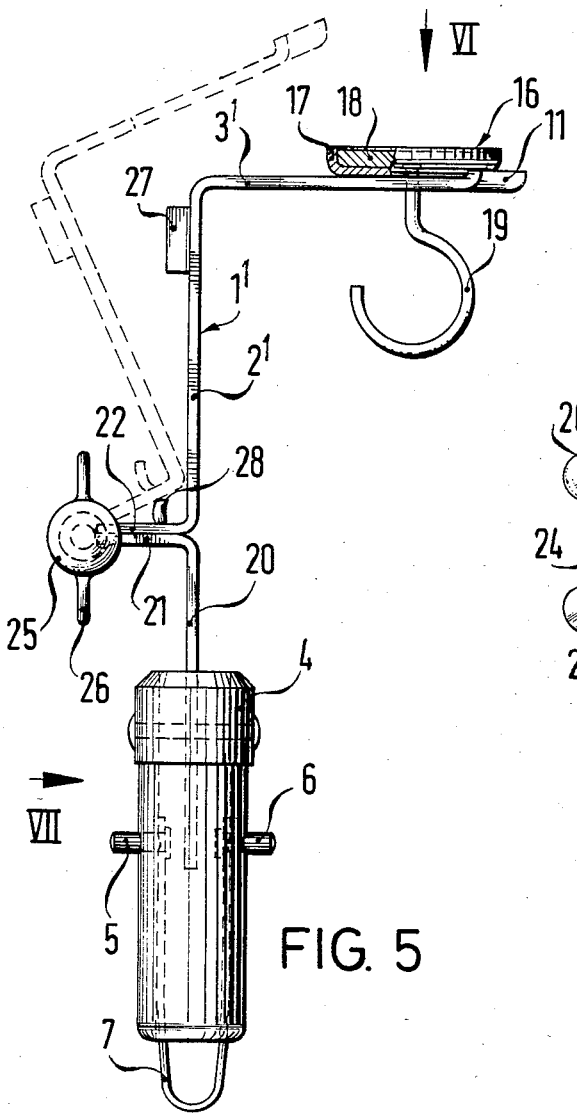
FIG. 5 is a side elevational view of the apparatus according to another embodiment of the invention, with a magnetic holder.

FIGS. 1 to 4 show one embodiment of the apparatus according to the present invention which consists of a substantially C-shaped carrier arm 1 of rectangular cross section having two spaced legs 2 and 3 and a web portion therebetween. The leg 2 is affixed by a rearwardly bent end part to the front end of a hollow cylindrical body 4. The wall of the hollow cylindrical body 4 is provided at its rear end with borings in which two opposite bolts 5 and 6 are displaceable against the force of a two-armed plate-shaped prestressed spring 7. The hollow cylindrical body 4 of the apparatus can be inserted in a handle bar 8 which can be extended and retracted telescopically, the bolts 5 and 6 engaging in corresponding borings in the casing of the handle bar 8. The leg 3 of the carrier arm 1 has a bifurcated portion 9 on the outer sides of which two opposite edge cutouts 10 are provided. The bifurcated portion 9 has forwardly bent free ends 11 (FIG. 2). The reference numeral 12 denotes a wood screw provided with a suspension hook 13. A transversal arm 14 is rigidly mounted on the shank of the wood screw 12 and is provided with rearwardly bent ends 15 (FIG. 3). The wood screw 12 is received, to enable it to be screwed in and out, in the edge cutouts 10 of the leg 3 of the carrier arm 1, as illustrated in FIG. 1 of the drawings.

FIG. 4 shows an embodiment in which instead of a wood screw a magnetic holder 16 consisting of a dish 17 and a magnetic disc 18 rigidly mounted in the dish 17 is used. A suspension hook 19 is affixed by its shank to the dish 17. To enable the magnetic holder 16 to be pressed against a structural part, for example, the magnetic holder 16 rests by its dish 17 on the leg 3 of the carrier arm 1, the suspension hook 19 passing through the bifurcated portion 9 of the leg 3 of the carrier arm 1. The magnetic holder 16 is secured in position on the leg 3 as a result of the fact that its dish 17 rests against the forwardly bent free ends 11 of the bifurcated portion 9.

Figure 7:
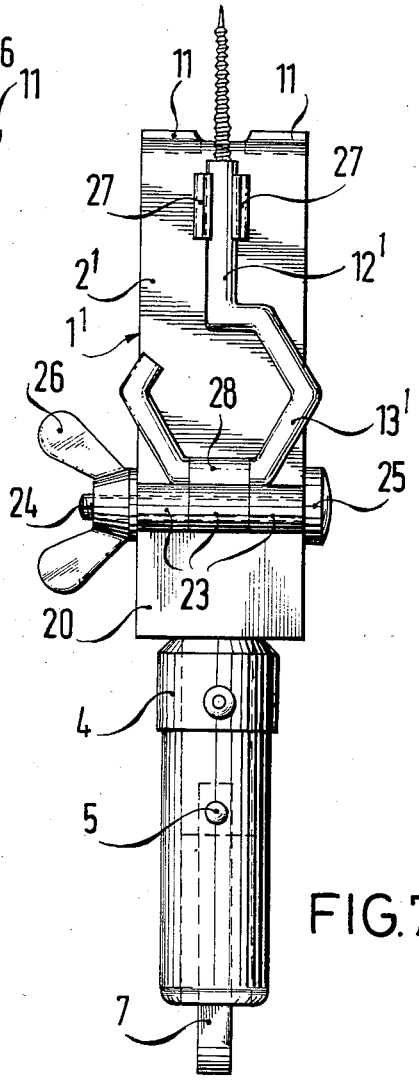
FIG. 7 is a side elevational view, seen in the direction of the arrow VII in FIG. 5, of the apparatus with a wood screw mounted in a manner different to that shown in FIG. 1.
Figure 6:
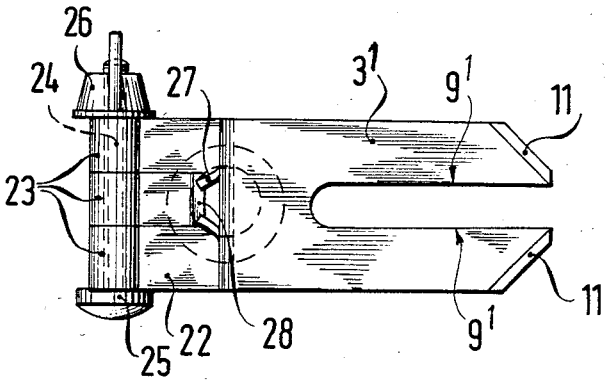
FIG. 6 is a plan view, seen in the direction of the arrow VI in FIG. 5, of the apparatus without the magnetic holder.
Figure 8:
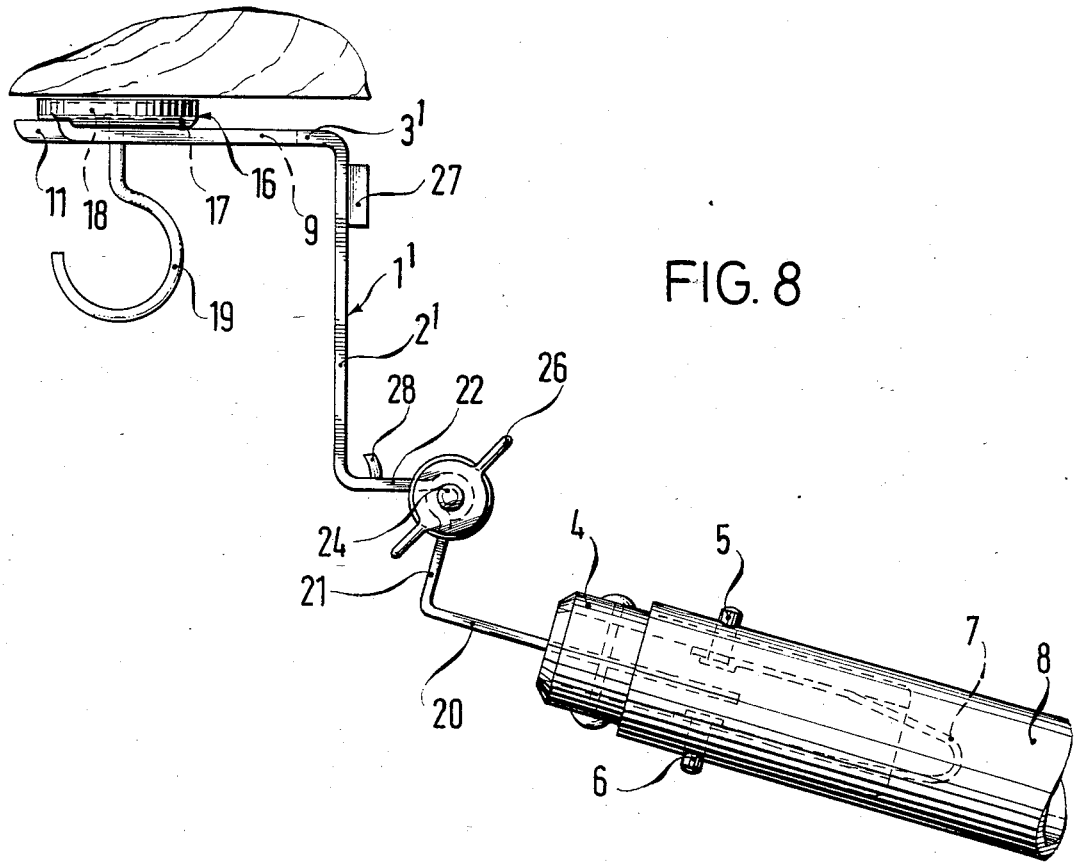
FIG. 8 is a side elevational view of the apparatus and the handle bar, the latter being adjusted to an angle in respect of the apparatus.

In the embodiment shown in FIGS. 5 to 8 of the drawings a holder 20 consisting of a flat material and having a rectangular cross section is rigidly inserted by one of its ends in the hollow cylindrical body 4. The holder 20 is provided at its other end with a bent part 21. The carrier arm $1^1$ consists of two legs $2^1$ and $3^1$ arranged in the form of an inverted L. The leg $2^1$ of the carrier arm $1^1$ of the apparatus also has a bent part 22 taking the same direction as the bent part 21. The bent parts 21 and 22 are provided with bearing eyes 23 produced by a rolling process and serving to accommodate a joint bolt 24 (FIGS. 7 and 8). The joint bolt 24 has a widened head 25 at one end, enabling it to rest against the bearing eye 23 facing towards it. By its other end, which is screw-threaded, the joint bolt 24 projects from its bearing. A screw nut 26 taking the form of a butterfly nut can be screwed onto the external thread of the joint bolt 24 and tightened against the bearing in order to secure the carrier arm $1^1$ in the particular position selected. The leg $2^1$ of the carrier arm $1^1$ is provided on its outer side with two clamps 27 fixed in position side by side at a certain distance apart, the bent part 22 of the leg $2^1$ being provided with a projection 28, which is produced by cutting out and bending it aside and with which the leg $2^1$ is parallel. The shank of the wood screw $12^1$ is secured by the clamps 27 on the leg $2^1$ of the carrier arm $1^1$, the threaded end of the said wood screw projecting forwards in relation to the leg $2^1$. The wood screw $12^1$ rests by its suspension hook $13^1$ on the bent part 22 of the leg $2^1$, on which it is secured by means of the projection 28 (FIG. 7).

After the screw nut 26 has been released the carrier arm $1^1$ can be set to the particular angular position required in relation to the handle bar 8 (FIG. 8) and is secured in this position after the screw nut 26 has been tightened up.

The invention may be embodied in other specific forms without departing from the spirit or essential characteristics thereof. The embodiments are therefore to be considered in all respects as illustrative and not restrictive.

What is claimed is:

1. A kit for securing and removing suspension means to and from a relatively high structure comprising:

(a) a suspension device comprising:

1. An elongated shank having screw threads at the front end thereof,
2. securing means at the opposite rear end thereof, and
3. projection means fixedly mounted of said shank intermediate the opposite ends thereof and extending radially from said shank and including a plurality of rearwardly extending projections spaced radially from said shank; and (b) a tool for mounting and demounting said suspension device comprising:

1. an axially extending elongated handle means having front and rear ends,
2. suspension device support means, and
3. means mounting said suspension device support means on said front end of said handle means with said suspension device support means in a plane perpendicular to the axis of said handle means,
4. said suspension device support means having a slot therein for receiving said shank of said suspension device adjacent the rear side of said projection means and having a plurality of recesses spaced from said slot for receiving respective of said rearwardly extending projection of said projection means such that said shank is maintained in axial alignment with said axis of said handle means;

(c) whereby an operator may press forwardly and rotate said handle means in one direction to screw said suspension device mounted on said suspension device support means into said relatively high structure to mount said suspension device therein without said tool contacting said structure and then withdraw said tool to disengage said tool from said suspension device and may engage said suspension device with said suspension device support means of said tool and rotate said handle means in the opposite direction to unscrew and withdraw said suspension device from said structure without said tool contacting said structure.

2. A kit according to claim 1 wherein said securing means of said suspension device is a hook.

3. A kit according to claim 1 wherein said projection means of said suspension device comprises at least two arms extending radially from said shank, one of said projections extending rearwardly from the end of each of said arms opposite said shank.

4. A kit according to claim 1 wherein the combination of said suspension device support means and said mounting means together have a C-shaped configuration, said mounting means comprising an elongated web portion having front and rear ends, said suspension device support means extending transversely from said front end of said elongated web portion and a rear leg extending transversely in alignment with said suspension device support means from the rear end of said web portion, said securing means of said suspension device being received between said suspension device support means and said rear leg.

5. A kit according to claim 4 wherein said handle means comprises a hollow cylindrical body, means connecting said hollow cylindrical body to said rear leg such that the axis of said hollow cylindrical body is transverse to said rear leg, a handle bar, and means for detachably securing said handle bar to said hollow cylindrical body such that said handle bar and hollow cylindrical body are in substantial axial alignment.

6. A kit according to claim 1 wherein said recesses in said suspension device support means are cut-outs in the external edges of said suspension device support means spaced from the opposite sides of said slot.

7. A kit according to claim 4 wherein the end of said suspension device support means opposite elongated web portion is bifurcated by said slot therein.

8. A tool for mounting and demounting a suspension device to and from a relatively high structure, said suspension device comprising an elongated shank having screw threads at the front end thereof, securing means at the opposite rear end thereof, and projection means fixedly mounted on said shank intermediate the opposite ends thereof and extending radially from said shank and including a plurality of rearwardly extending projections spaced radially from said shank; said tool comprising:

(a) an axially extending elongated handle means having front and rear ends;

(b) suspension device support means; and (c) means mounting said suspension device support means on said front end of said handle means with said suspension device support means in a plane perpendicular to the axis of said handle means, (d) said suspension device support means having a slot therein for receiving said shank of said suspension device adjacent the rear side of said projection means and having a plurality of recesses spaced from said slot for receiving respective of said rearwardly extending projections of said projection means such that said shank is maintained in axial alignment with said axis of said handle means;

(e) whereby an operator may press forwardly and rotate said handle means in one direction to screw said suspension device mounted on said suspension device support means into said relatively high structure to mount said suspension device therein without said tool contacting said structure and then withdraw said tool to disengage said tool from said suspension device and may engage said suspension device with said suspension device support means of said tool and rotate said handle means in the opposite direction to unscrew and withdraw said suspension device from said structure without said tool contacting said structure.

9. A tool for mounting and demounting a suspension device comprising an elongated shank having screw threads at the front end thereof and a hook at the opposite rear end thereof; said tool comprising:

(a) an axially extending elongated handle means having front and rear ends;

(b) suspension device support means; and (c) means mounting said suspension device support means on said front end of said handle means;

(d) said suspension device support means comprising a first releasable clamp means adapted for engaging said hook of said suspension device and preventing reward movement of said suspension device realtive to said tool and a second releasable clamp means adapted for engaging said shank of said suspension device, said first and second releasable clam means being arranged to releasably secure said suspension device with said shank susbstantially parallel to the axis of said handle means;

(e) an arm extending transversely of the axis of said handle means from the end of said suspension device support means opposite said handle means, said arm having a rear side facing said handle means and an opposite front side and having a slot therein for receiving a further suspension device comprising a shank having magentic attachment means at the front end thereof and a hook at the opposite rear end thereof (f) whereby an operator may press forwardly and rotate said handle means in one direction to screw said suspension device mounted on said suspension device support means into said relatively high structure to mount said suspension device therein without said tool contacting said structure and then withdraw said tool to disengage said tool from said suspension device and may engage said suspension device with said suspension device support means of said tool and rotate said handle means in the opposite direction to unscrew and withdraw said suspension device from said structure without said tool contacting said sturcture, said tool may be utilized for supporting said further suspension device with said magnetic attachment means resting on said front side of said leg, said shank passing through said slot and said hook at the rear side of said leg to position said further suspension device on said relatively high structure.

10. A tool according to claim 9 wherein said suspension device support means is in a plane substantially parallel to said axis of said handle means.

11. A tool according to claim 10 wherein said first releasable clamp means is adapted for engaging the portion of said hook in axial alignment with said shank of said suspension device.

12. A tool according to claim 11 wherein said handle means comprises a hollow cylindrical body, means connecting said hollow cylindrical body to said suspension device support means, a handle bar, and means for detachably securing said handle bar to said hollow cylindrical body such that said handle bar and hollow cylindrical body are in substantial axial alignment.

13. A tool according to claim 9 wherein the end of said leg opposite said suspension device support means and on opposite sides of said slot projects forwardly to retain said further suspension device.

14. A tool according to claim 13 wherein said suspension device supoort means further comprises adjustable pivot means for adjusting the angle of said leg relative to the axis of said handle means about an axis substantially perpendicular to said axis of said handle means.

* * * * *